United States Patent [19]

Trumley

[11] Patent Number: 4,640,061

[45] Date of Patent: Feb. 3, 1987

[54] ROLL-FORMED FRAME FOR PORTABLE ENCLOSURES

[75] Inventor: Richard L. Trumley, Charlotte, Mich.

[73] Assignee: General Aluminum Products, Inc., Charlotte, Mich.

[21] Appl. No.: 155,466

[22] Filed: Jun. 2, 1980

[51] Int. Cl.[4] ..... E04B 1/346

[52] U.S. Cl. ..... 52/71; 52/82; 52/586; 52/656

[58] Field of Search ..... 52/82, 71, 586, 656; 24/230 AS, 211 P, 214, 230 R

[56] References Cited

U.S. PATENT DOCUMENTS

| | | | |
|---|---|---|---|
| 988,900 | 4/1911 | Schmidt . | |
| 2,351,419 | 6/1944 | Fuller . | |
| 2,703,159 | 3/1955 | Van Fleet . | |
| 2,810,460 | 10/1957 | Winnan . | |
| 2,927,354 | 3/1960 | Lauer . | |
| 2,956,315 | 10/1960 | Lipp et al. . | |
| 3,066,770 | 12/1962 | Millard et al. . | |
| 3,321,885 | 5/1967 | Pratt | 52/657 |
| 3,333,373 | 8/1967 | Taylor et al. | 52/63 |
| 3,335,535 | 8/1967 | Lane | 52/204 |
| 3,367,701 | 2/1968 | Wenk, Jr. | 24/230 R X |
| 3,374,597 | 3/1968 | Whitener | 52/738 |
| 3,426,482 | 2/1969 | Mock | 49/501 |
| 3,952,463 | 4/1976 | Lane | 52/63 |
| 3,996,706 | 12/1976 | Bomgaars | 52/82 X |
| 4,183,693 | 1/1980 | Berdan | 403/295 |
| 4,205,486 | 6/1980 | Guarnacci | 49/501 |
| 4,240,765 | 12/1980 | Offterdinger | 52/656 X |

FOREIGN PATENT DOCUMENTS

| | | |
|---|---|---|
| 567572 | 12/1958 | Canada . |
| 355770 | 1/1938 | Italy . |
| 1042736 | 9/1966 | United Kingdom . |

*Primary Examiner*—Carl D. Friedman

*Attorney, Agent, or Firm*—Price, Heneveld, Cooper, DeWitt & Litton

[57] ABSTRACT

A roll-formed frame is provided for portable enclosures of the type comprising a series of screened wall panels with flexible hinges interconnecting the upright edges of the same. The wall panels are arranged into a closed polygon configuration, and support a domed, fabric roof. A pair of flexible cables extend around the top and bottom of the wall panels with retainers interconnecting the same, and retain the wall panels and roof in position. Roll-formed frame segments are interconnected to form the rectangular margin of the wall panels, and include a roll-formed channel in the outer peripheral edge. The channel has a dovetailed shape to interchangeably receive and retain therein a bead portion of the hinge, the fastener cables, and a body portion of the retainers. Preferably, the beads on the flexible hinge have a wedge shape which fits loosely into the side channels, and the cable retainers are symmetrical, so that they can be used on either end of the wall panels.

22 Claims, 15 Drawing Figures

ROLL-FORMED FRAME FOR PORTABLE ENCLOSURES

BACKGROUND OF THE INVENTION

The present invention relates to portable enclosures, and in particular to a roll-formed frame arrangement therefor.

Portable closures or shelters, such as those disclosed in U.S. Pat. Nos. 3,335,535 and 3,952,463 (which are incorporated by reference herein) have become increasingly popular in recent years. Such structures typically comprise a series of screened wall panels, which are interconnected along their upstanding edges by flexible hinges. The wall panels are arranged in a closed polygon configuration, and support a dome-shaped, fabric roof. A door is provided in the structure to access the interior, and solid or opague panels can be installed over the screens to keep out gentle rain, wind, insects, etc, as well as to provide privacy.

The frames for the wall panels are generally constructed from extruded aluminum, with channels disposed along the side edges in which an I-shaped flexible hinge is mounted. The extruded frames require a relatively thick sidewall, in the nature of 0.045 inches, thereby resulting in high material costs, as well as expensive transportation and storage. The flanges or beads along the side edges of the flexible hinge are rectangular, and are typically fitted rather tightly into the mating frame channels, so as to form a reasonably weathertight seal therebetween. Since the flexible hinges are rather long, the assembly of the hinges into the frame channels by pulling the hinge beads therealong is a difficult task which can easily result in damage to the flexible hinges.

Retainers are used at the ends of each of the wall panels to hold the fastening cables in position. Heretofore, the legs of the retainer were manually compressed, and then inserted into the frame end. Wind and other forces acting on the roof and wall panels of the shelter are transmitted to the cables, and pull outwardly on the retainers. Prior to the present invention, separate left and right hand retainers were required to assemble the shelter, and the same had a tendency to inadvertently unlock from the frame when the shelter was exposed to gusts of wind, or other similar extreme forces.

SUMMARY OF THE INVENTION

One aspect of the present invention is to provide a roll-formed frame for collapsible shelters of the type described above, comprising a series of wall panels interconnected by flexible hinges and arranged into a closed polygon configuration. Since the frame is roll-formed, it can be constructed from a much thinner material, thereby reducing material costs, transporation costs, other associated expenses, and assembly effort, as well as provide a more rigid structure with harder and more durable exterior surfaces. The frame segments which form the margin of the wall panels include a roll-formed channel disposed in the outer, peripheral edge. The channel has a dovetailed shape which is adapted to interchangeably receive and retain therein either a bead portion of one of the hinges, one of the cable fasteners, or a body portion of a cable retainer.

Another aspect of the present invention is to provide a flexible hinge for collapsible shelters, having a web with wedge-shaped beads disposed along the side edges thereof. The beads are sized to be slidingly received and retained in adjacent frame channels with a loose fit to facilitate assembly. When adjacent wall panels are assembled into the closed polygon position, the beads abut against the associated channel wall to form a seal between the wall panels.

Yet another aspect of the present invention is to provide a cable retainer for collapsible shelters which has a body with a pair of resilient prongs extending therefrom in a parallel, spaced apart fashion for sliding insertion into the end of a frame member. Both of the prongs have an outwardly oriented, resilient tab in the shape of a barb which is adapted to be received into a mating frame member aperture to securely lock the retainer in place. The prongs are substantially identical in shape, and are arranged symmetrically on the retainer body, whereby the retainer can be used interchangeably at either end of the frame member.

Yet another aspect of the present invention is to provide a corner key for interconnecting adjacent wall panel frame segments. The corner key is shaped to fit frictionally within the frame segments, whereby the adjacent frame segments are securely interconnected without staking or otherwise anchoring the key in place.

The principal objects of the present invention are to provide a thin walled, roll-formed frame for collapsible shelters to reduce fabrication cost, transportation cost, and assembly effort. Roll-formed dovetailed grooves are provided along the outer periphery of the frame, and are shaped to interchangeably receive either a hinge bead, a fastener cable segment, or a retainer body therein, such that the entire frame margin can be constructed from the same frame stock. The wedge-shaped hinge beads are designed to fit loosely in the channels to facilitate assembly, and are capable of providing a seal when the panels are disposed in an assembled position. The cable retainers have a symmetrical design, such that they can be used interchangeably at either end of the frame. The retainers have prongs with inclined surfaces which are recieved in wedge shaped slots in the interior of the frame, thereby securely retaining the same in position. A corner key securely interconnects adjacent frame segments without being staked therein.

These and other features, advantages and objects of the present invention will be further understood and appreciated by those skilled in the art by reference to the following written specification, claims and appended drawings.

DETAILED DESCRIPTION OF THE PREFERRED EMBODIMENTS

Figure 1:
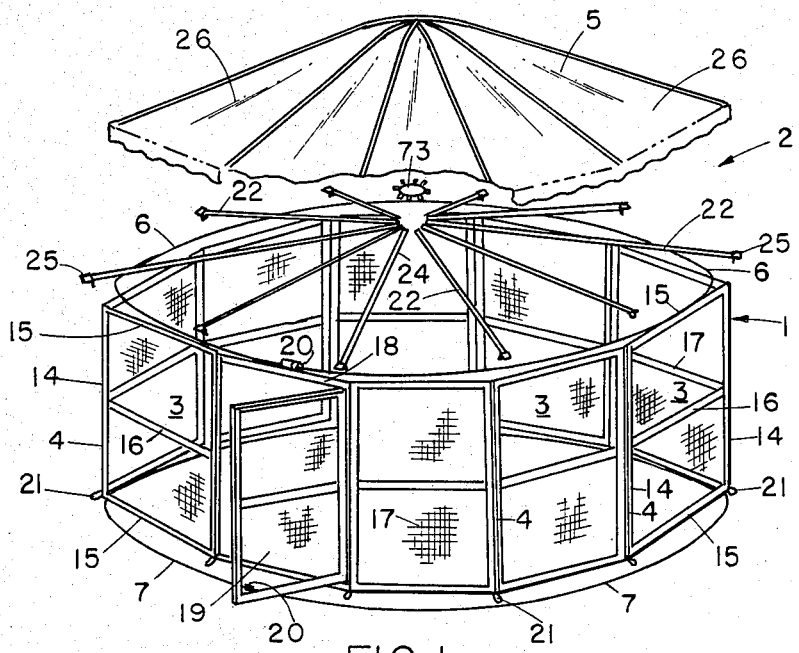
FIG. 1 is an exploded, perspective view of a collapsible shelter embodying the present invention.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations, except where expressly specified to the contrary.

Figure 2:
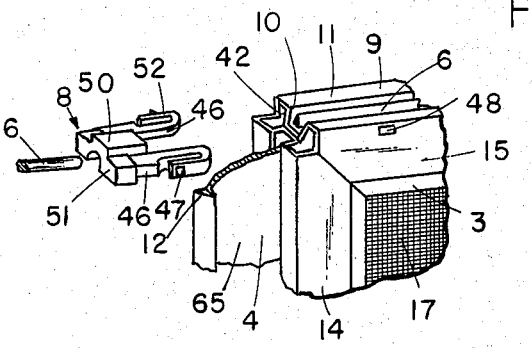
FIG. 2 is an exploded, fragmentary, perspective view of a frame portion of the shelter and a cable retainer therefor in a disassembled condition.

Reference numeral 1 generally designates a roll-formed frame construction, which embodies the present invention and is adapted for constructing portable enclosures or shelters 2. The illustrated shelter 2 comprises a series of wall panels 3 with flexible hinges 4 interconnecting the upright edges of the same. Wall panels 3 are arranged into a closed polygon configuration, and support a roof 5. A pair of flexible cables 6 and 7 extend around the top and bottom of the wall panels 3, with retainers 8 interconnecting the same, and retain the wall panels and the roof in position. Roll-formed frame segments 9 (FIG. 4) are interconnected to form the margin of wall panels 3, and include a roll-formed channel 10 in the outer, peripheral edge 11. Channel 10 has a dovetailed shape to interchangeably receive and retain therein either a bead portion 12 (FIG. 2) of a hinge 4, one of the fastener cables 6 and 7, or a section of cable retainer 8.

The illustrated shelter 2 is merely illustrative of that type of collapsible enclosure for which the present roll-formed frame arrangement is particularly adapted. Each wall panel 3 includes a horizontally oriented cross brace 16, which extends between side frame segments 14, and divides the panel into upper and lower section in which a panel of wire mesh or screen 17 is mounted. One of the wall panels 3 includes a casing or mullion 18 with a door 19 hingedly mounted therein to access the interior of the shelter. The ends of fastener cables 6 and 7 are interconnected by a pair of conventional snaps 20, disposed over and under door 19. As described in greater detail hereinafter, only one side of the door casing 18 is disconnected from adjacent panels when the shelter is collapsed and stored. Flexible loops 21 are positioned between adjacent panels at the bottom thereof, and are attached at one end to the lower fastener cable 7 and at the other end to a stake (not shown) or another similar tie-down device to anchor the shelter to the ground.

The illustrated roof assembly 5 comprises a plurality of flexible tube members 22 and a central hub 23 having a plurality of radially protruding studs which are received in the inner ends 24 of tube members 22. The outer ends 25 of tube members 22 include a hook shaped fitting which engages the upper fastener cable 6 to connect the roof assembly 5 with the wall panels 3. In use, tube members 22 are compressed or bowed, and support a waterproof, fabric covering 26, such as canvas, to form a dome shaped roof. The bowed roof supports 22 apply a radially outward force to the upper cable 6, which tends to pull the wall panels away from each other along their side edges, as more fully explained in the incorporated Lane patents.

Figure 4:
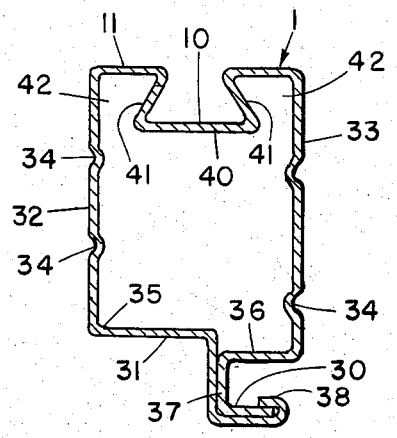
FIG. 4 is an enlarged, lateral cross-sectional view of a segment of frame stock.
Figure 5:
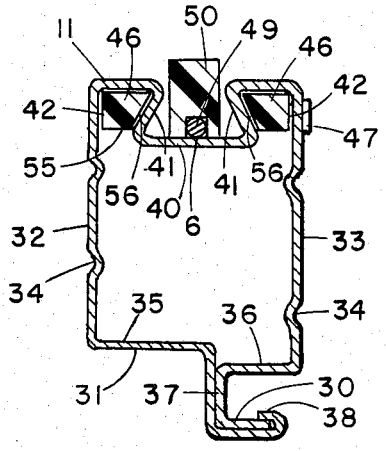
FIG. 5 is an enlarged, cross-sectional view of the frame, with the retainer positioned therein, taken along the line V—V, FIG. 3.

As best illustrated in FIGS. 4 and 5, the rollformed frame section or stock 1 has a generally rectangular transverse cross-sectional shape, with channel 10 disposed along the outer peripheral edge 11, and a laterally oriented channel 30 extending along the inner edge 31. The frame stock includes a pair of parallel sidewalls 32 and 33 disposed on the interior and exterior sides respectively of the shelter. Both sidewalls 32 and 33 include a pair of ribs 34 which extend longitudinally therealong and provide additional rigidity, and improve the appearance of the frame. The inner edge 31 of the frame has a stepped design, and includes an interior side 35 and an exterior side 36, which converge at a position slightly exterior of the center line of the channel to form the base 37 of channel 30. The terminal end 38 of side 35 is wrapped around the edge of side 36, and is crimped thereon to interconnect the side edges of the sheet, and form the lower flange of channel 30. Channel 30 is generally U-shaped and adapted to receive and retain therein the peripheral edge of a panel of wire mesh or screen 18, secured therein in a conventional fashion.

The channel 10 is dovetail shaped or mortised, and includes a base 40 and inclined sides 41 which extend convergingly from base 40 to the outer peripheral edge 11. The illustrated channel sides 41 are inclined at an angle of approximately 60° to the base 10, such that the channel has a lateral cross section in the shape of an equilateral trapezoid, or a truncated equilateral triangle. The edges of channel 10 are rounded, which facilitates engagement with the hinge bead 12. A pair of wedge shaped slots 42 (FIG. 4) are formed between the frame sidewalls 32 and 33, the channel sides 41, and the peripheral edge 11, and include an open, lower side. Slots 42 are of a trapezoidal shape for purposes to be described below.

Since the frame stock 1 is roll-formed, each frame section is integral and one-piece, and the sidewalls of the channel are relatively thin. For example, it has been determined that collapsible shelter frame members which are roll-formed from aluminum with a 0.024 inch thickness, are structurally comparable with extruded aluminum channels having a wall thickness of 0.045 inches. This represents a reduction in material usage and weight of approximately 50%. Further, the roll-forming process cold works the exterior of the material, thereby providing a harder, more durable surface.

Each wall panel frame 9 has a substantially rectangular marginal shape, with side frame segments 14 (FIG. 1) and top and bottom frame segments 15 securely interconnected. The frame segments 14 and 15 are each constructed from a length of roll-formed frame stock 1, as illustrated in FIG. 4, with channel 10 oriented in a radially outward direction, and channel 30 facing outwardly from the exterior of the shelter.

Figure 11:
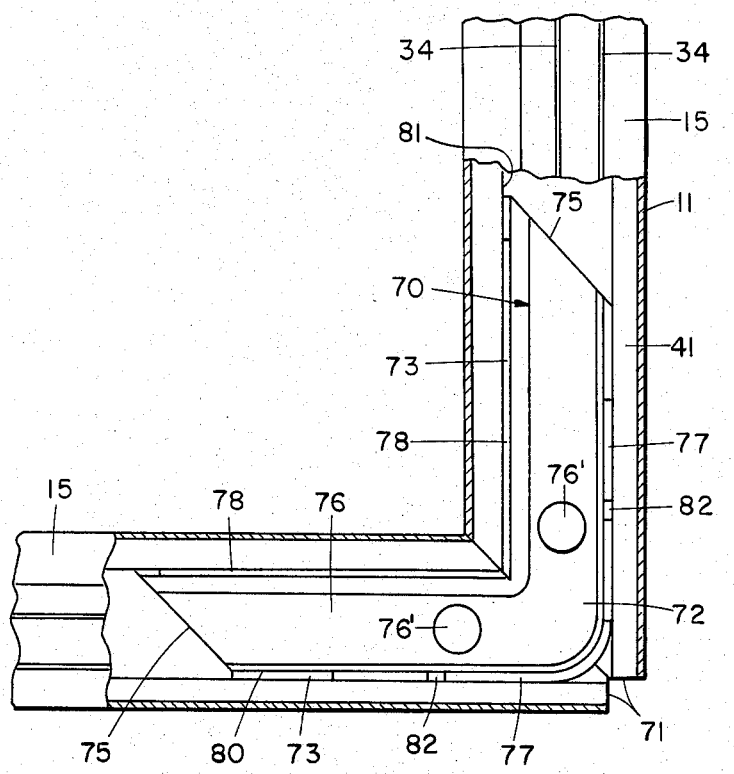
FIG. 11 is a side elevational view of a corner of the frame, with portions thereof broken away to reveal a corner key.
Figure 12:
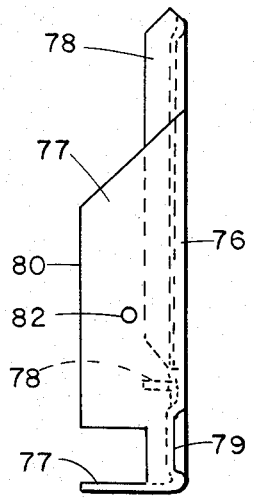
FIG. 12 is an end elevational view of the corner key.
Figure 13:
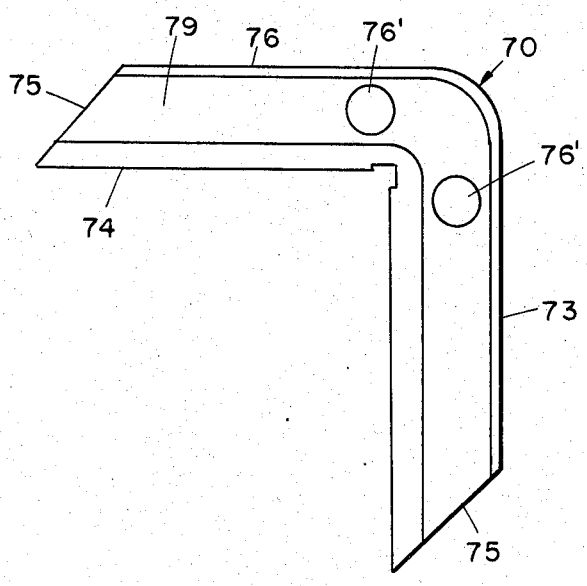
FIG. 13 is a side elevational view of the corner key of FIG. 11, taken from the opposite side thereof.
Figure 14:
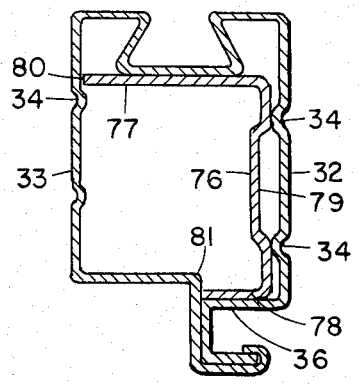
FIG. 14 is an enlarged cross-sectional view of the frame and corner key.

The frame segments 14 and 15 are preferably interconnected by corner keys 79 (FIGS. 11–15), which are received telescopingly into the interior of adjacent frame segments at each corner of the wall panel frames. The ends of those frame segments 14 and 15 which form the margin of the wall panels are cut along a 45° angle (i.e. mitered), with a square edge or notch 71 at the exterior corner to expose channel 10 and provide a space into which a retainer 8 can be inserted. The corner keys 70 have an L-shaped body 72, as viewed in FIGS. 11 and 13, comprising legs 73 and 74 with inclined ends 75. In transverse cross section (FIG. 14), key 70 includes a base 76 with two flanges 77 and 78 extending from opposite sides thereof. The base 76 of the key has a height substantially coextensive with the distance between the inner surfaces of frame portions 36 and 40, and includes a recessed center area 70 which extends between ribs 34. A pair of apertures 76' extend through the recessed base adjacent the intersection of the legs 73 and 74. The upper flange 77 of key 70 extends between the frame sidewalls 32 and 33, with the upper surface abutting the channel base 40, and the free edge 80 positioned just above the adjacent sidewall rib 34. Apertures 82 are located in the flanges 77 of both legs 73 and 74 for purposes to be described below. The lower flange 78 of the key extends between the right hand sidewall 32 and the ledge 81 on frame segment 35, thereby capturing the corner key in the interior of the frame, and retaining the same in position. The flanges 77 and 78 have tapered leading edges, are resilient, and act like leaf springs in abutting their mating surfaces 40 and 36 to maintain the vertical position of the key. Contact between the flange free edge and the interior of sidewall 33, as well as between the nonrecessed portions of the key base 76 and the ribs 34 position the key laterally in the frame. The frictional forces developed as a result of the above described surface abutment are preferably sufficient to securely retain the key in adjacent frame segments without requiring staking the key in place or any other positive anchoring or interconnection, thereby facilitating assembly of the frame.

Figure 15:
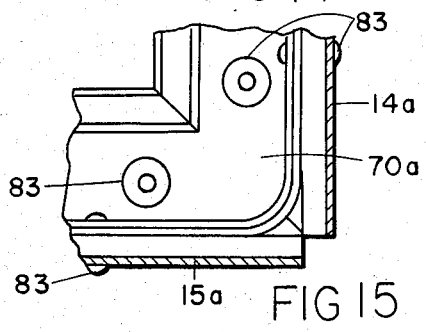
FIG. 15 is a cross-sectional view of another embodiment of the present invention, wherein the corner key is staked in the frame.

In the embodiment illustrated in FIG. 15, the corner key **70*a* is positively attached to the adjacent frame segments 14*a* and 15*a* by suitable fasteners, such as pop rivets 83, which are recieved in key apertures 76*a* and 82*a*. Since this embodiment is otherwise similar to the arrangement shown in FIGS. 11–14, similar parts appearing in FIGS. 11–14 and 15** respectively are represented by the same, corresponding reference numeral, except for the suffix "a" in the numerals of the latter.

Figure 3:
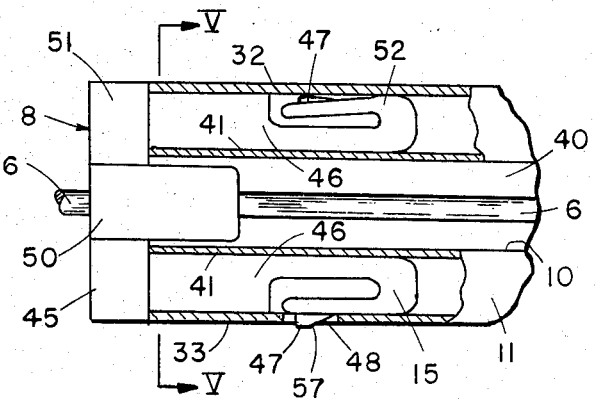
FIG. 3 is an enlarged, fragmentary, top plan view of one end of the frame, with portions thereof broken away to show the retainer in an assembled condition.
Figure 6:
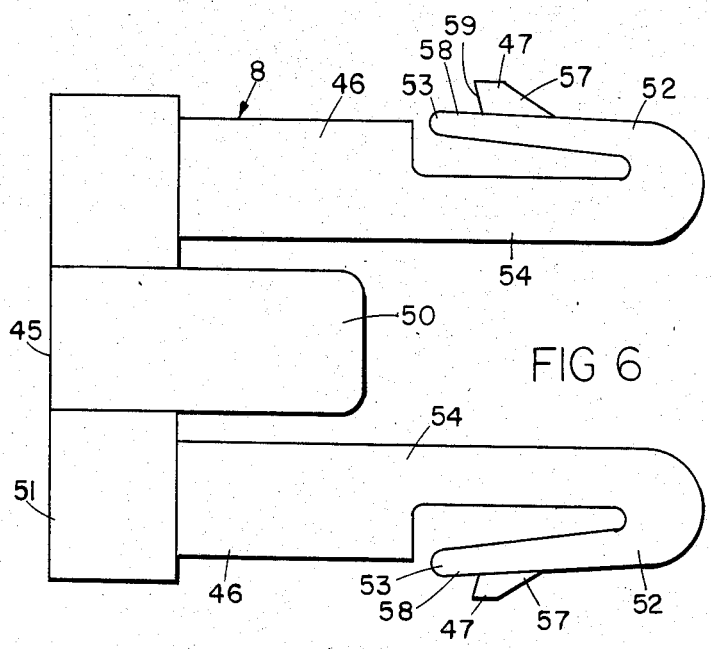
FIG. 6 is a further enlarged, top plan view of the retainer.
Figure 7:
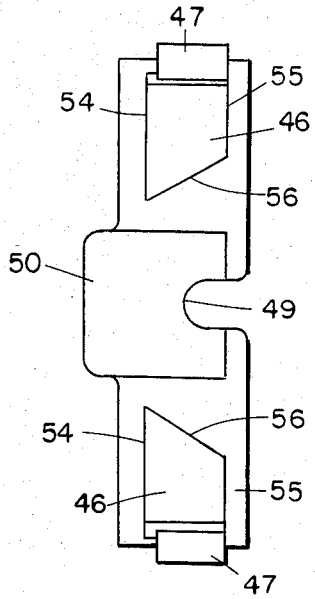
FIG. 7 is a further enlarged, end elevational view of the retainer.
Figure 8:
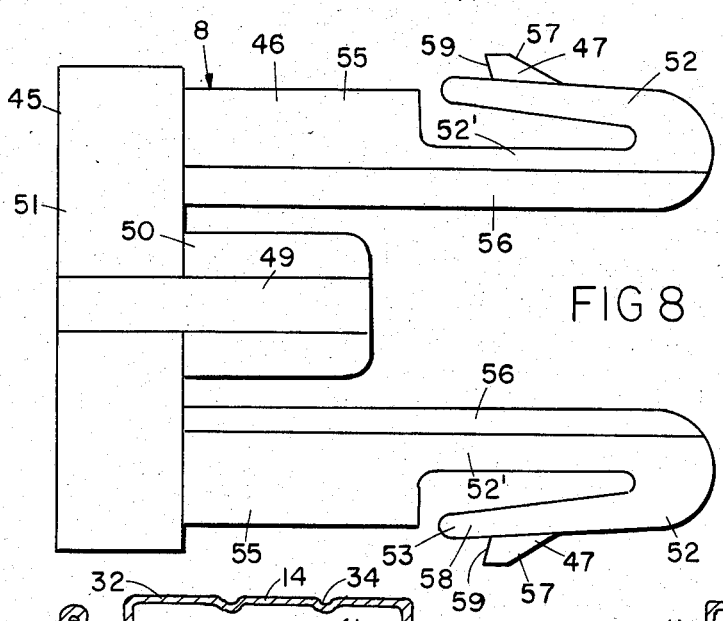
FIG. 8 is a further enlarged, bottom plan view of the retainer.

As best illustrated in FIGS. 6–8, cable retainers 8 include a body 45 from which a pair of parallel, spaced apart prongs 46 extend. Each prong 46 includes a tab or barb 47, which is shaped to be received in a mating aperture 48 (FIG. 3) in the exterior sidewall 33 of the frame to lock the retainer in place. The retainer body 45 is T-shaped from the top plan view (FIG. 6), and includes a notch or groove 49 (FIGS. 7 and 8) extending along a central portion 50 of the body. The central body portion 50 has a lateral width which is slightly less than the distance between the upper edges of channel 10, and is adapted to be slidingly received therebetween. The central body section 50 protrudes from a forward body plate 51 in the direction of prongs 46, in a peninsular or cantilevered fashion. A section of fastener cable 6 or 7 is received in channel 49, and is retained in a sandwiched configuration against the bottom of channel 10 by the retainer. Prongs 46 are generally J-shaped as viewed in FIGS. 6 and 8, with base 52' and resilient free ends 52 which extend outwardly with the barbs 47 thereon. Although the prong bases 52' may be rigid, the retainers 8 are preferably integrally molded from a resilient material, such as Zytel nylon. The top and bottom surfaces 54 and 55 of prongs 46 are flat and parallel, and the inside surfaces 56 (FIGS. 7 and 8) are angled or beveled inwardly from the bottom to the top surfaces. Prongs 46 are generally shaped to be telescopically received in wedge shaped slots 24, as best illustrated in FIG. 5. The beveled prong faces 56 are inclined at an angle substantially commensurate with that of the sidewalls 41, and the wedge-shaped design prevents both vertical and lateral movement of the retainer. It is noteworthy that when retainer 8 is locked in the frame end, the retainer prongs 46 are disposed wholly inside the frame, and are not in the dovetailed channel 10.

The barbs 47 (FIGS. 6–8) have an inclined camming surface 57 which is adapted to engage the sidewalls 32 and 33 of the frame and bend the free ends 52 of the prongs inwardly toward the prong bases 52'. The bending of the prong free ends 52 takes place from the base of the U-shaped prong portion to the barb 47, while the prong bases 52' remain relatively stationary. Barbs 47 are postioned slightly upstream of the prong terminal end 53, so as to form a stop surface 48 to limit the expansion of the compressed prong ends when the barb is in registry with the mating frame aperture 48 to retain the barb and the frame aperture in alignment. Barbs 47 also have end surfaces 59 which are inclined at an angle of approximately 45° from prong end 52 in a direction opposite to the direction of retainer insertion. When the retainer prongs 46 are inserted into slots 42, the barbs 47 abut the sidewalls 32 and 33, thereby compressing free ends 52 slightly. The barb 46 on the apertured sidewall 33 springs outwardly through aperture 48 when the same are aligned, thereby locking the barb in place. Any outward movement of retainer 8 causes the inclined barb end 59 to abut the forward edge of the sidewall forming aperture 48, thereby holding the barb securely in the extended, locked position. As outwardly applied forces on retainer 8 are increased, the locking forces which resist retainer withdrawal automatically increase. To release retainer 8, the retainer must first be moved to the fully inserted position in the frame channel 10. Barb 47 is then depressed inwardly until the barb clears the inside edge of the aperture 48. Retainer 8 is then telescopingly withdrawn from the end of the frame section. Since the prongs 46 are substantially identical in shape and are arranged symmetrically on the retainer body 45, the retainer can be used interchangeably at either end of the frame member. In this manner, the structure does not require differently shaped left and right hand retainers. The nonoperative barb 47 (the upper barb in FIG. 3) remains in the compressed position during retainer insertion, with frictional engagement against the sides of the slot 42. A retainer 8 is positioned at both ends of both the upper and lower frame segments 15 to hold each of the fastener cables 6 and 7, such that four retainers are required for each wall panel 3.

Figure 9:
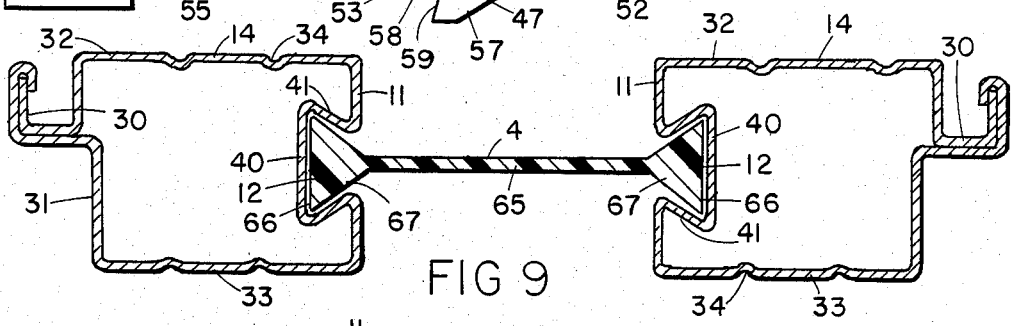
FIG. 9 is an enlarged, horizontal cross-sectional view of adjacent frame members with a hinge mounted therein, shown in an assembly position.
Figure 10:
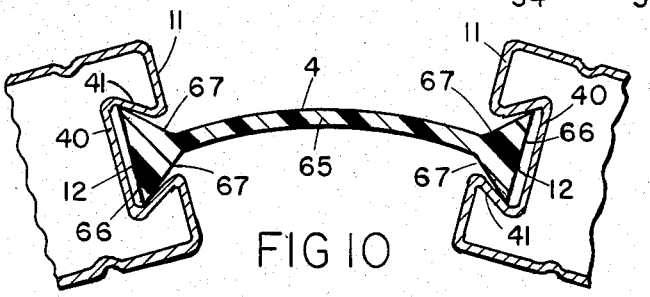
FIG. 10 is an enlarged, horizontal cross-sectional view of the adjacent frame members and hinge of FIG. 9, shown when the shelter is in an assembled or closed polygon configuration.

As best illustrated in FIGS. 9 and 10, flexible hinge 4 comprises a flat web 65 with wedge-shaped beads 12 in the nature of tenons disposed along the side edges thereof. Beads 12 are sized with respect to channel 10 to be slidingly received and retained therein with a loose fit, such that the hinges 4 can be easily installed in the panels by threading the hinge beads through adjacent frame channels. In the illustrated structure, hinge beads 12 have a solid, triangular lateral cross-sectional shape, with the base portion 66 disposed adjacent the channel base 40 and the web 65 extending between the bead apexes, and preferably molded integrally therewith. The sides 67 of hinge beads 12 are inclined at an angle which is less than the channel sidewalls 41 to facilitate both insertion and sealing. In this example, sides 67 are disposed at an angle of approximately 50° from the bead base 66. When adjacent wall panels 3 are substantially in line, as shown in FIG. 9, as for assembly of the hinges 4, there is sufficient clearance between the hinge beads 12 and the channels 10 to permit the hinge to be easily threaded into and pulled through the channels. The angle differential and clearance between the hinge beads 12 and frame channels 10 permits the shelter to be assembled by a single person, unlike prior structures which required at least two persons. When the shelter is assembled, adjacent wall panels are pivoted to the closed polygon position (as shown in FIG. 10). The bowed roof supports 22 apply outwardly directed radial forces to the upper cable 6, which tend to pull adjacent wall panels apart. This action, along with any canting or cocking movement of the hinge beads 12 in the channel 10 forms a reasonably weathertight seal. It is to be understood that although the sealing action between the hinge 4 and the wall panel edges is not airtight, it is sufficient to impede the flow of rain, wind, insects, and other such elements. Hinge 4 is preferably constructed from a relatively soft, flexible material, such as flexible PVC (90 durometer), or the like.

In use, shelter 2 is assembled in a conventional fashion, as disclosed in the referenced Lane patents. Basically, the interconnected wall panels 3 are unfolded from the stored condition, and positioned into a closed polygon configuration. The free side of the door assembly 18 is connected with the adjacent wall panel 3 by a hinge 4. The ends of the upper and lower fastener cables 6 and 7 are connected at opposite ends of the door assembly by clips 20. The tubular roof supports 22 have their inner ends connected with hub 23, and their outer ends positioned between adjacent wall panels, with the fittings 25 engaged with the upper cable 6. The length of roof supports 22 is selected so that they must be resiliently bowed into the assembled position, thereby forming a dome-shaped frame on which flexible cover 26 is supported. Stakes (not shown) are driven through loops 21 to anchor the shelter to the ground. Because the wall panel frames are roll-formed, they can be manufactured with much thinner sidewalls, thereby reducing material costs, transportation costs, and assembly effort. Since such structures are collapsible and portable, this is a very important consideration. The frame stock provides a dovetail shaped channel 10 which is adapted to interchangeably receive either a hinge bead 12, a fastener cable 6 or 7, or the body portion of a cable retainer 8 therein, such that one frame stock design can be used for both the side segments and the top and bottom segments of the frame, thereby further reducing manufacturing costs. The wedge shaped beads 12 of the flexible hinge 8 are sized to facilitate quick and easy assembly, without sacrificing sealing capability. Further, because the cable retainers are symmetrically shaped, a single retainer design can be used on either end of the wall panel. The shape of the retainer barbs 47 provides a secure lock which prevents inadvertent withdrawal of the retainer.

In the foregoing description, it will be readily appreciated by those skilled in the art that many modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. In a collapsible shelter comprising a series of wall panels with flexible hinges interconnecting the same along their upright edges; said wall panels being arranged in a closed polygon configuration and supporting a roof to form an enclosure, and including at least one fastener cable with retainers to hold said wall panels and said roof in position, the improvement wherein:

said wall panels comprise roll-formed frame segments interconnected to form the margin of said wall panels; said frame segments including a roll-formed channel disposed in an outer, peripheral edge thereof; said channel having a dovetailed shape adapted to interchangeably receive and retain therein a bead portion of said hinges, said fastener cable, and a body portion of said retainers;

said wall panels have a substantially rectangular shape, and include a pair of side frame segments, and top and bottom frame segments;

said hinge bead is disposed in the channels in said side frame segments;

said fastener cable is disposed in the channel of one of said top and bottom frame segments;

said retainers are positioned in the ends of those frame segments in which said fastener cable is disposed;

said roll-formed frame segments include a pair of spaced apart sidewalls disposed adjacent opposite sides of said channel and formed integrally therewith;

said channel and said frame sidewalls form a pair of wedge-shaped slots on either side of said channel in the interior of said frame segment; and said retainers include a body with a pair of wedge-shaped prongs which are matingly received into said slots at the ends of those frame segments in which said fastener cable is disposed.

2. A collapsible shelter as set forth in claim 1, wherein:

said flexible hinges have a web with wedge-shaped beads disposed along side edges thereof; said beads being sized to be slidingly received and retained in adjacent side frame segment channels with a loose fit.

3. A collapsible shelter as set forth in claim 2, wherein:

said hinge beads have a trianglar lateral cross-sectional shape which seals in the associated frame segment channel when said shelter is assembled.

4. A collapsible shelter as set forth in claim 1, including:

a second fastener cable disposed in the channel of the other of said top and bottom frame segments, and including retainers positioned in the ends thereof.

5. A collapsible shelter as set forth in claim 4, wherein:

said top and bottom frame segments include an aperture through one sidewall thereof adjacent the ends of said frame segment;

said cable retainer prongs have a resilient barb shaped to be received in said frame aperture, and are symmetrically arranged, whereby said retainers can be used interchangeably at either end of said frame segments.

6. A collapsible shelter as set forth in claim 5, wherein:

said retainer prongs have resilient, J-shaped ends which extend outwardly with said barbs disposed adjacent terminal ends thereof.

7. A collapsible shelter as set forth in claim 6, wherein:

said barbs have an outwardly inclined camming surface adapted to engage the sidewalls of said frame member and compresses the J-shaped prong ends.

8. A collapsible shelter as set forth in claim 7, wherein:

said barbs have end surfaces inclined in a direction opposite to the direction of retainer insertion to prevent inadvertent withdrawal of said retainer.

9. A cable retainer as set forth in claim 8, wherein:

said barbs include a stop surface adapted to limit the expansion of said compressed prong ends when the barb is in registry with the mating frame aperture, and to retain said barb and said frame aperture in alignment.

10. A cable retainer as set forth in claim 8, wherein:

said retainer body includes a leading end which projects from said retainer body and is adapted to be disposed in said channel when said retainer is inserted into one of the channel members.

11. A cable retainer as set forth in claim 10, wherein:

said retainer body includes a groove disposed along a bottom surface of said leading end and shaped to receive said fastener cable therein for holding the same in the center of said channel against a base portion of said channel.

12. In a cable retainer for collapsible shelters and the like of the type comprising a series of wall panels hingedly connected along their upright edges and arranged to form a closed polygon enclosure; said retainer having a portion thereof received into a channel at the ends of top and bottom frame members, and including means for locking said retainer in place, the improvement wherein:

said retainer comprises a body having a pair of resilient prongs extending therefrom in a parallel, spaced apart fashion for sliding insertion into one of the frame member ends; both of said prongs having an outwardly oriented, resilient barb adapted to be received in a mating frame member aperture to lock said retainer in place; said prongs being substantially identical in shape and arranged symmetrically on said retainer body, whereby said retainer can be used interchangeably at either end of said frame member; and said retainer prongs have resilient J-shaped ends which extend outwardly, with said barbs disposed adjacent free ends thereof.

13. A cable retainer as set forth in claim 12, wherein:

said barbs have an outwardly inclined camming surface adapted to engage sidewalls of said frame member and compress the J-shaped prong ends.

14. A cable retainer as set forth in claim 12, wherein:

said barbs have end surfaces inclined in a direction opposite to the direction of retainer insertion to prevent inadvertent withdrawal of said retainer.

15. A cable retainer as set forth in claim 14, wherein:

said barbs include a stop surface adapted to limit the expansion of said compressed prong ends when the barb is in registry with the mating frame aperture, and to retain said barb and said frame aperture in alignment.

16. A cable retainer as set forth in claim 12, wherein:

said retainer body includes a leading end which projects from said retainer body and is adapted to be disposed in said channel when said retainer is inserted into one of said frame members.

17. A cable retainer as set forth in claim 16, wherein:

said retainer body includes a groove disposed along a bottom surface thereof, and shaped to receive a fastener cable therein.

18. A cable retainer as set forth in claim 12, wherein:

said retainer prongs each have an inclined interior surface adapted to be received in wedge-shaped slots formed in the interior of said frame members between frame sidewalls and a dovetailed channel in the periphery of said frame members.

19. In a cable retainer for collapsible shelters and the like of the type comprising a series of wall panels hingedly connected along their upright edges and arranged to form a closed polygon enclosure; said retainer having a portion thereof received into a channel at the ends of top and bottom frame members, and including means for locking said retainer in place, the improvement wherein:

said retainer comprises a body having first and second resilient prongs extending therefrom in a spaced apart fashion for sliding insertion into one of the frame members ends; at least one of said prongs having an outwardly oriented, resilient, J-shaped end, with a barb disposed adjacent the free end of said one prong, and adapted to be received in a mating frame member aperture to lock said retainer in place.

20. A cable retainer as set forth in claim 19, wherein:

said barb has an outwardly inclined camming surface adapted to engage sidewalls of said frame member and compress the J-shaped prong end.

21. A cable retainer as set forth in claim 20, wherein:

said barb has an end surface inclined in a direction opposite to the direction of retainer insertion to prevent inadvertent withdrawal of said retainer.

22. A cable retainer as set forth in claim 21, wherein:

said barb includes a stop surface adapted to limit the expansion of said compressed prong end when the barb is in registry with the mating frame aperture, and to retain said barb and said frame aperture in alignment.

* * * * *